US012324532B1

(12) United States Patent
Ham

(10) Patent No.: US 12,324,532 B1
(45) Date of Patent: Jun. 10, 2025

(54) PORTABLE BEVERAGE HOLDER DEVICE

(71) Applicant: Mitchell Ham, Goldsboro, NC (US)

(72) Inventor: Mitchell Ham, Goldsboro, NC (US)

( * ) Notice: Subject to any disclaimer, the term of this patent is extended or adjusted under 35 U.S.C. 154(b) by 0 days.

(21) Appl. No.: 19/070,232

(22) Filed: Mar. 4, 2025

(51) Int. Cl.
*A47G 23/02* (2006.01)

(52) U.S. Cl.
CPC ..... *A47G 23/0266* (2013.01); *A47G 23/0241* (2013.01); *A47G 2023/0275* (2013.01)

(58) Field of Classification Search
CPC ..... A45F 3/44; A45F 5/1583; A47B 13/16; A47G 19/30; A47G 2023/0275; A47G 23/0225; A47G 23/0241; A47G 23/0266; A63B 2225/682; B62J 11/04; B63B 29/12; Y10S 224/926
USPC ..... 383/13
See application file for complete search history.

(56) References Cited

U.S. PATENT DOCUMENTS 3,840,204 A * 10/1974 Thomas ..... B63B 29/12 224/406
4,997,156 A * 3/1991 Allen ..... A47C 7/624 248/314
5,325,991 A * 7/1994 Williams ..... B65D 81/3879 224/543
5,624,064 A * 4/1997 McGee, Jr. ..... B62J 11/04 215/373
5,673,835 A * 10/1997 Kalat ..... B62J 11/04 224/544
6,575,417 B1 * 6/2003 Krommenakker ..... A47G 23/0225 248/156
D660,102 S * 5/2012 Allred ..... D7/704
9,226,604 B1 * 1/2016 Steele ..... A47F 7/28
10,722,025 B2 * 7/2020 Flores ..... A47B 13/023
11,819,151 B2 * 11/2023 Baldridge ..... A47G 23/0225
2012/0187136 A1 * 7/2012 Smith ..... A47G 23/0225 220/737
2017/0197721 A1 * 7/2017 Ellis ..... B64D 11/0638
2019/0387906 A1 * 12/2019 Cruickshank ..... B65D 21/086

* cited by examiner

*Primary Examiner* — Nathan J Newhouse
*Assistant Examiner* — Matthew T Theis
(74) *Attorney, Agent, or Firm* — Ashley D. Johnson; Dogwood Patent and Trademark Law

(57) ABSTRACT

The invention is a lightweight, easily transportable, and effective solution for securing beverages and small items in outdoor settings. The device includes a pouch that releasably attaches to an elongated support through the use of a connecting pin. By utilizing a simple pouch and articulating joint system, this invention provides a more versatile and user-friendly alternative to existing outdoor beverage holders.

20 Claims, 12 Drawing Sheets

PORTABLE BEVERAGE HOLDER DEVICE

FIELD OF THE INVENTION

The presently disclosed subject matter relates to beverage holders, specifically a portable beverage holder designed to secure drinks and/or personal items while engaging in outdoor activities. The presently disclosed subject matter also includes methods of making and using the portable beverage holder.

BACKGROUND OF THE INVENTION

In their free time, people commonly engage in recreational activities, such as camping, swimming, and the like. During these activities, bottled water and other beverages are commonly placed on the ground, leading to spills and similar inconveniences. In response, beverage holders have been developed. Unfortunately, existing drink holding devices suffer from many disadvantages. For example, current beverage holders are often bulky and difficult to transport. Some types of prior art drink holders utilize multiple sets of arms and post extensions that make the devices complex and cumbersome to use. Still other beverage holders include screw-in mechanisms for stability that limit the device repositioning flexibility. Often, conventional drink holders use tubes with a fixed spiral receptacle for the beverage that are difficult to use in uneven terrain. It would therefore be beneficial to provide a simple and effective beverage holder that allows a user to place a beverage and/or small personal items in a secure pouch attached to a ground inserted support. It would further be beneficial if the device was easy to use, stable, and allowed for quick repositioning when needed, even on unlevel ground.

SUMMARY OF THE INVENTION

In some embodiments, the presently disclosed subject matter is directed to a device (e.g., a holding device). Specifically, the device comprises a pouch with a top end and an opposed bottom end, and an opening in fluid communication with a front side of the pouch (e.g., extending into the pouch interior). The pouch also includes an aperture positioned at the first end of the pouch on a rear side of the pouch. The device further comprises a pin comprising a first end and an opposed second end, wherein the first end of the pin is attached to the first end of the pouch via a linker. The device includes an elongated support member comprising a first end and an opposed second end with a length therebetween, wherein the support member first end includes a cavity. The device includes a flange positioned at the second end of the support member, the flange having a diameter that is greater than a diameter of the support member, wherein the flange includes a first side positioned adjacent to the second end of the support and an opposed second side. The device includes an anchor positioned adjacent to the second side of the support. In a device first orientation, the pin second end is removably housed within the cavity at the first end of the support via an articulating joint. In a device second orientation, the pin second is withdrawn from the cavity. In the first configuration, the pouch remains horizontal regardless of an angle of the support. The term "horizontal" refers to a direction in a plane parallel to a typical flat surface. Thus, the pouch remains horizontal or level (e.g., not at an angle relative to a flat surface).

In some embodiments, the pouch is constructed from one or more insulated materials.

In some embodiments, the pouch is constructed from one or more waterproof or water-resistant materials.

In some embodiments, the linker is selected from one or more of a metal clip, string, elastic cord, clip, snap, loop, button, magnet, or hook and loop closure.

In some embodiments, the support member is constructed from lightweight, corrosion-resistant materials. The term "lightweight" can refer to the characteristic of being of less weight compared to corresponding articles constructed from conventional material. Thus, the lightweight support member can be easily carried by a single person. For example, suitable lightweight materials can include aluminum, carbon fiber, fiberglass, titanium, or combinations thereof. The term "corrosion-resistant" refers to the characteristic of being able to resist deterioration caused by exposure to the environment. For example, a corrosion resistant material is also able to resist salt spray or immersion testing. An exemplary salt spray testing is disclosed in ASTM B 117-07 titled "Standard Practice for Operating Salt Spray (Fog) Apparatus", as a non-limiting example which is incorporated herein by reference in its entirety. Suitable corrosion resistant materials can include aluminum and aluminum alloys, zinc, zinc alloys, fiberglass, or combinations thereof.

In some embodiments, the anchor includes a first end positioned adjacent to the second end of the flange and an opposed second end configured as a chamfered tip. The term "chamfered" refers to a beveled edge connecting two surfaces at right angles, such as at or about 45 degrees.

In some embodiments, the length of the support member is adjustable in size, length, or both. Thus, the length and/or size of the support member can be elongated or shortened as desired by a user.

In some embodiments, the pin first end extends above the first end of the support member in the first configuration.

In some embodiments, the presently disclosed subject matter is directed to a method of storing an item in the pouch of the disclosed device. Particularly, the method comprises positioning the item within the pouch interior, positioning the second end of the pin within the support member cavity to releasably attach the pouch to the support member first end, and positioning the anchor into a support surface such that the support member and pouch are stabilized into position and the item is stored within the pouch. Advantageously, the pouch remains horizontal regardless of an angle of the support.

In some embodiments, the item is a beverage selected from a bottle, can, or other container.

In some embodiments, the item is selected from one or more keys, phones, wallets, purses, coins, money, credit cards, or jewelry.

In some embodiments, the method includes folding the rear face of the pouch onto itself. For example, the rear face of the pouch can be folded such that the top exterior surface contacts the exterior surface at a location lower than the top surface.

In some embodiments, the item can be removed from the pouch interior at any desired time.

DETAILED DESCRIPTION OF THE INVENTION

Figure 1:
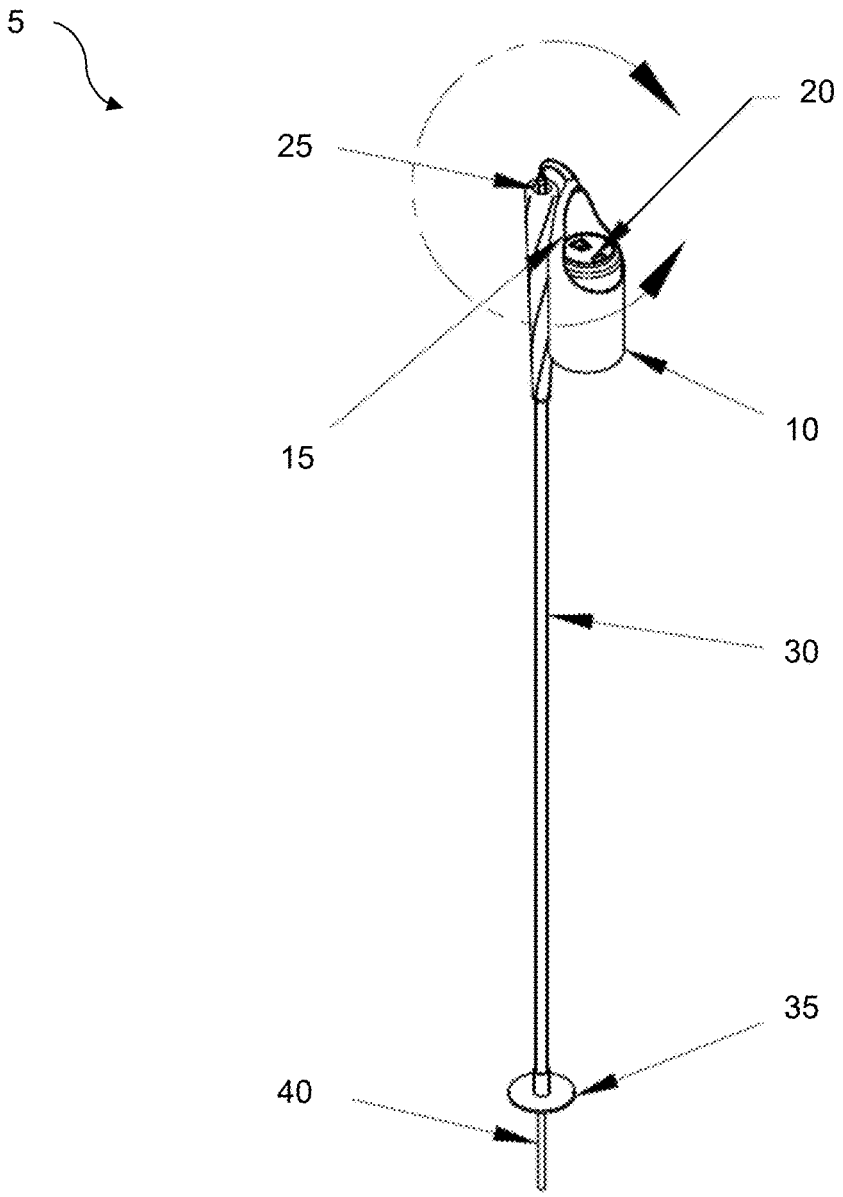
FIG. 1 is a perspective view of a holding device in accordance with some embodiments of the presently disclosed subject matter.

For the purpose of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e., at least one) of the grammatical object of the article. By way of example, "an element" means at least one element and can include more than one element. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods. Thus, the term "about" is used to provide flexibility to a numerical range endpoint by providing that a given value may be "slightly above" or "slightly below" the endpoint without affecting the desired result.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any unclaimed element as essential to the practice of the invention.

Unless otherwise defined, all technical terms used herein have the same meaning as commonly understood by one of ordinary skill in the art to which this disclosure belongs.

The presently disclosed subject matter is directed to a portable holding device that accommodates one or more beverages and/or small personal items and allows for quick repositioning in a wide variety of terrains. FIG. 1 illustrates one embodiment of holder device 5 that includes pouch 10 with opening 15 configured to house an item 20, such as a beverage container, personal item (e.g., keys, wallet, phone), or combinations thereof. The pouch includes pin 25 that cooperates with the first end of support member 30 to retain the pouch at an elevated position for easy user access. The second end of the support member cooperates with flange 35 and anchor 40 that maintain proper positioning of the device during use, as set forth in detail below. Advantageously, the disclosed device conveniently and reliably secures a desired item (e.g., a beverage) in a wide variety of terrains, such as sand, grass, rocks, and the like.

Figure 2A:
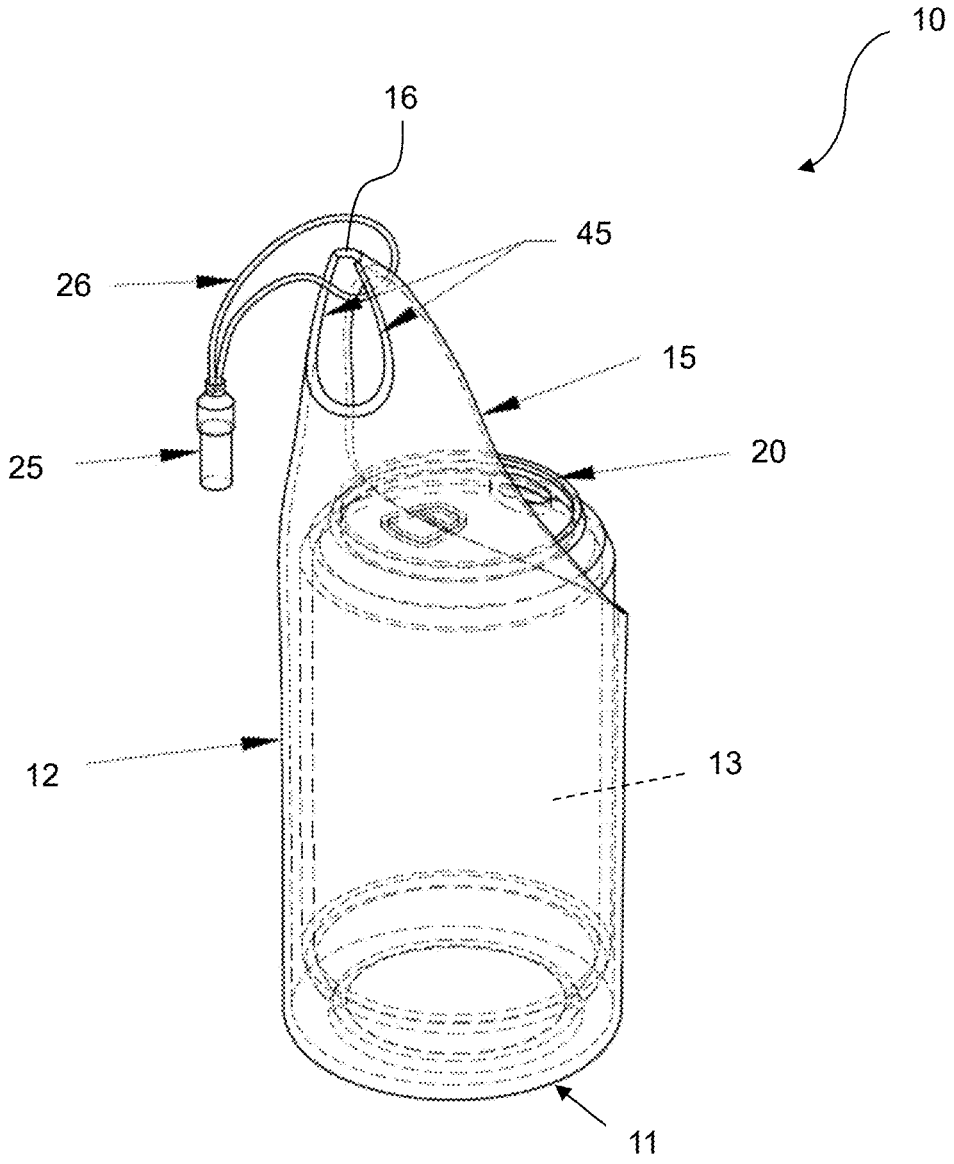
FIG. 2*a* is a perspective view of a device pouch and pin assembly in accordance with some embodiments of the presently disclosed subject matter.
Figure 2B:
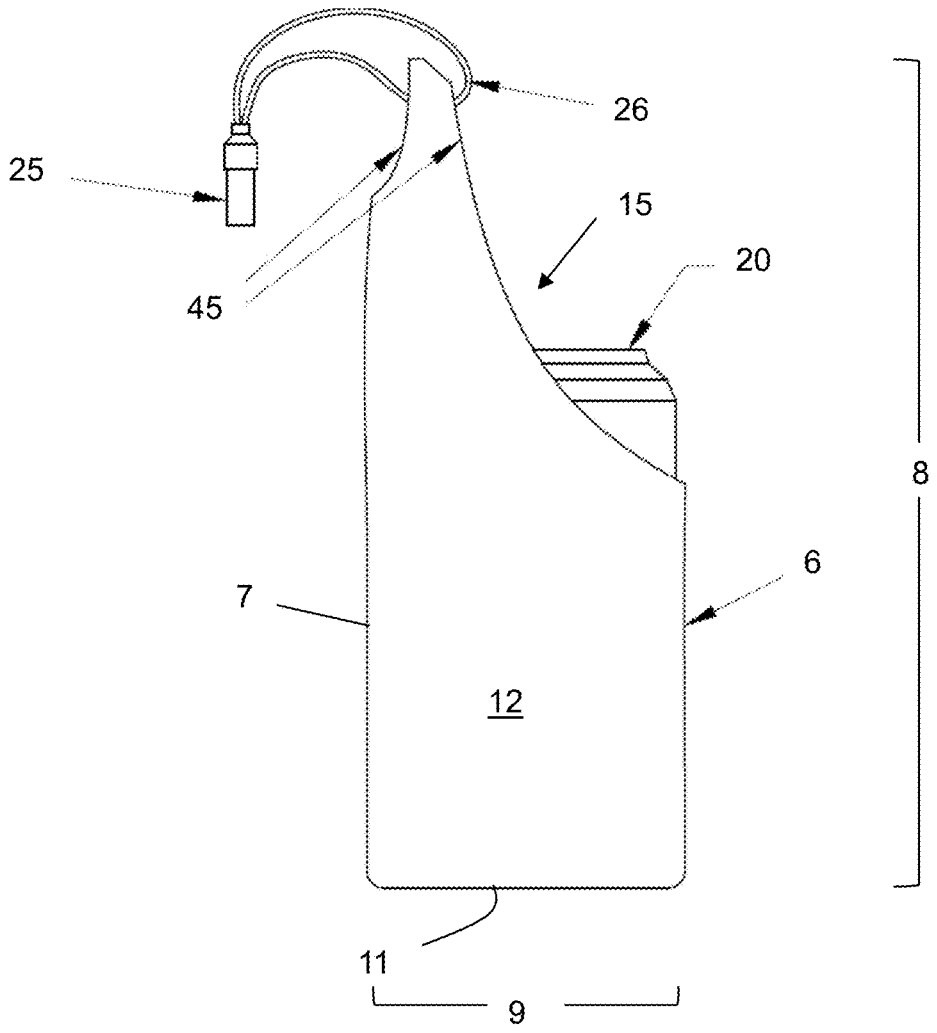
FIG. 2*b* is a side plan view of a device pouch and pin assembly in accordance with some embodiments of the presently disclosed subject matter.

As set forth above, device 5 includes pouch 10 defined by opening 15 sized and shaped to house one or more products 20. The term "pouch" refers to any vessel that can be used to carry or house a product. As illustrated in FIGS. 2*a* and 2*b*, the pouch includes bottom 11 joined to one or more sidewalls 12 to create interior 13. The pouch also includes opening 15 that allows a user to insert and remove a desired item 20 from the interior of the pouch. For example, pouch interior 13 can house a bottle (e.g., water bottle, sports drink bottle, juice bottle), can (e.g., soda can, beer can), cup, flask, thermos, canister, and the like. Thus, the pouch can house a wide variety of containers in an assortment of shapes and sizes made from a range of materials (e.g., aluminum, glass, plastic). It should be appreciated that the pouch can house beverages as well as other items, such as snacks, tools (e.g., nuts and bolts), keys, wallets, phones, or other items that the user wishes to keep secure.

Pouch opening 15 is designed to accommodate beverage cans, bottles, and other items without requiring excessive force. Specifically, the opening is positioned on a front half of the pouch (e.g., on front face 6), with an elongated shape that extends above the height of the can or bottle, adjacent to top 16 of the pouch. Stated another way, the opening creates a difference in height between front face 6 and opposed rear face 7. In this way, the can or bottle can be easily inserted or removed from the front (e.g., adjacent to front face 6), giving the user sufficient access to grasp the container as needed. Thus, the user can grasp a portion of the extended rear face as leverage to easily remove item 20 from the pouch interior.

The pouch also includes aperture 45 positioned at a top side of the pouch (adjacent to top edge 16) that can be used to hang or suspend the pouch to a desired height, as shown in FIG. 2*a*. In some embodiments, the aperture is positioned on rear face 7 of the pouch while opening 15 is on the front side of the pouch (e.g., the aperture and opening can be opposed). In this way, when the pouch is hung during use, opening 15 will face outwards (e.g., towards the user), allowing for easy access to item 20.

FIGS. 2*a* and 2*b* illustrate pouch 10 configured in a generally cylindrical shape. However, the pouch is not limited and can include any desired shape. For example, the pouch can have any cross-sectional shape, such as circular, oval, square, rectangular, triangular, pentagonal, hexagonal, octagonal, abstract, and the like.

Pouch 10 can be constructed from any desired material. For example, the pouch can include one or more flexible or semi-rigid materials. The term "flexible" refers to a material that is pliable and capable of flexing and/or bending without breaking. The term "semi-rigid" refers to a characteristic that allows a material to bend without breaking but not to same degree as a flexible material. Thus, the materials used to construct the pouch can be easily stretched or manipulated to accommodate items of various shapes and sizes within interior 13. Suitable flexible and semi-rigid materials can include (but are not limited to) fabric, foam, neoprene, mesh, rubber, leather, foil, silicone, plastic, or combinations thereof.

Figure 2C:
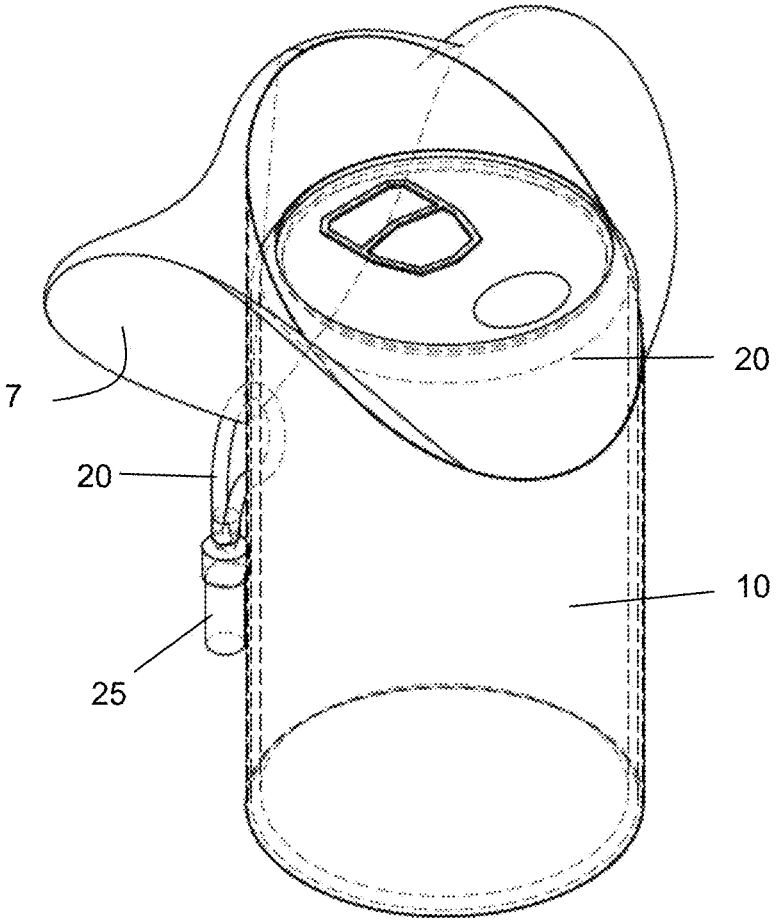
FIG. 2*c* is a perspective view of a device pouch comprising a folded rear face in accordance with some embodiments of the presently disclosed subject matter.
Figure 2D:
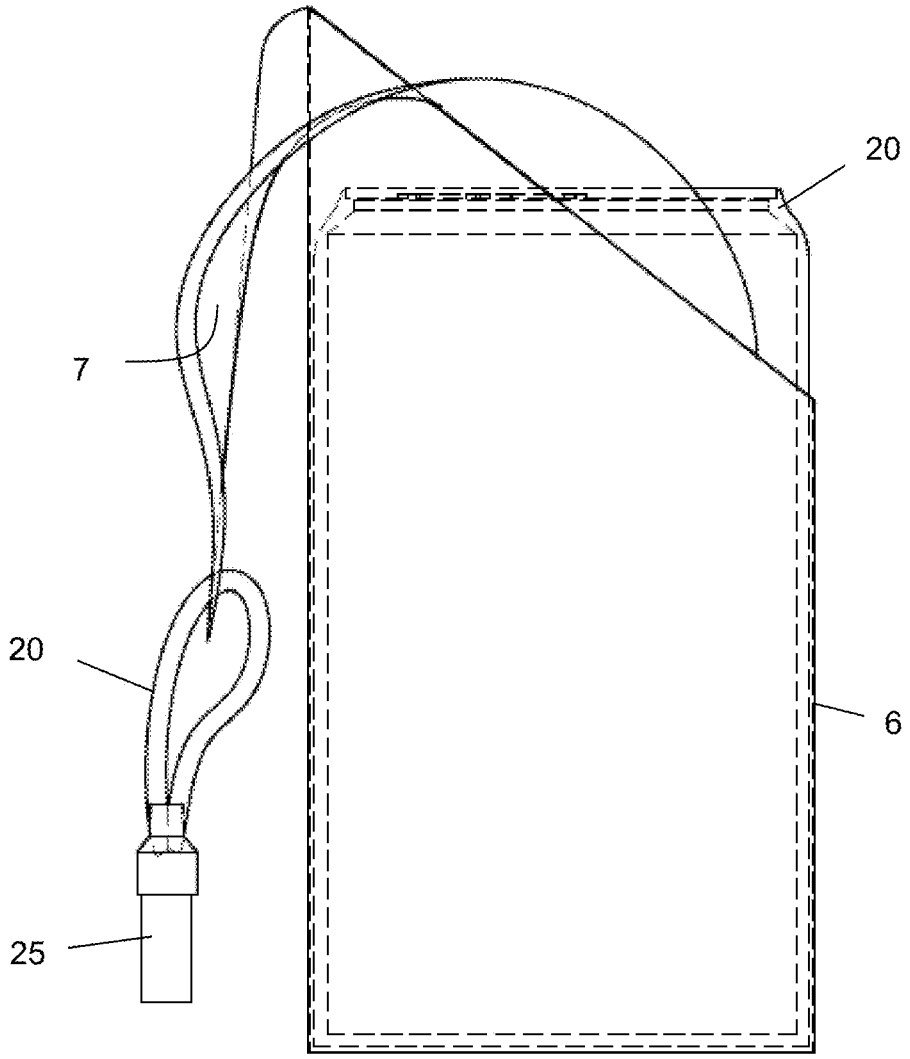
FIG. 2*d* is a cross-sectional side view of a device pouch with a folded rear face in accordance with some embodiments of the presently disclosed subject matter.

In some embodiments, the materials used to construct the pouch are elastic in nature, allowing pouch interior 13 to be easily stretched to accommodate containers of various shapes and sizes. Thus, the pouch can be conformable to any size and/or shape of beverage container 20, providing a "one size fits all" benefit. Suitable elastic materials can include (but are not limited to) one or more of stretchable fabric, elastomer, elastic, nitrile rubber, silicone rubber, polybutadiene, polyisoprene, ethylene/vinyl acetate, and the like. The term "elastic material" is therefore broadly construed to include any material that allows stretching to accommodate an object that is larger in size, allowing for a snug fit. Advantageously, an elastic pouch allows the pouch to stretch to accommodate different beverages and the rear face and/or front face of the pouch can be folded down to allow for unencumbered drinking of the beverage, as illustrated in FIGS. 2*c* and 2*d*. To elaborate, rear face 7 can fold downward back to contact itself. The front face of the pouch can also fold downward to allow for free access to the container. In this way, the opening of the container can be accessed by the user's mouth. Once folded, the front and/or rear flaps retain the folded orientation until a user unfolds them to the orientation of FIG. 2*b*.

It should be appreciated that suitable pouch materials are not limited and in some embodiments the pouch can be constructed from a rigid material that is stiff and/or hard. Suitable rigid materials can include hard plastic, metal, Styrofoam®, fiberglass, and the like. Thus, pouch 10 can be constructed from any desired material(s). In these embodiments, the pouch may not bend to accommodate easier drinking from container 20.

In some embodiments, the materials used to construct pouch 10 can be insulative materials that resist temperature changes (e.g., keeping beverage containers cool or warm as desired). An "insulative material" as used herein therefore refers to a material that resists a change in temperature. For example, when a cool beverage is inserted into pouch interior 13, the insulative pouch materials aid in maintaining the beverage at a cool temperature. It should be appreciated that the insulative material likewise functions to keep a hot or warm beverage from cooling off. Thus, the pouch can be used to hold hot materials (e.g., a cup of coffee) or cold materials (e.g., a can of beer). The receptacle therefore insulates the pouch from the ambient atmosphere, lengthening the time interval for the beverage to reach the ambient temperature. In addition, the insulative materials allow the receptacle to maintain a comfortable hand temperature by shielding the user's hand from the cold (or hot) container while drinking. Suitable insulated materials can include (but are not limited to) silicon, ceramics, glass, plastic, foam, polyethylene foam, neoprene, fabric, or combinations thereof. Thus, pouch 10 can keep beverages housed within the pouch interior cool for extended periods in some embodiments. In some embodiments, the insulative materials are positioned in pouch interior 13, as an interior layer, or as an exterior layer of the pouch.

Pouch 10 can also be constructed from one or more waterproof or water-resistant materials. The term "waterproof" refers to a material that does not permit passage of a liquid therethrough. The term "water resistant" refers to the ability of a material to resist the penetration of water and/or other liquids. In this way, pouch 10 can be used to prevent damage to an item (e.g., phone) during rain or other inclement weather. Suitable waterproof and/or water resistant materials can include (but are not limited to) foam, plastic, natural rubber, synthetic rubber, polyurethanes, acrylics, or combinations thereof.

Pouch 10 can be manufactured in various colors and/or patterns, providing variety and selection to the user.

Pouch 10 can be configured in any desired size. For example, in some embodiments, the pouch can include height 8 of about 3-10 inches and width 9 of about 2-6 inches. Thus, the pouch can have a height of at least about (or no more than about) 3, 4, 5, 6, 7, 8, 9, or 10 inches and a width of at least about (or no more than about) 2, 3, 4, 5, or 6 inches. However, the pouch is not limited and can include a height and width outside the given ranges. The term "height" refers to the longest straight line vertical distance between the top of the pouch (element 16) and bottom 11. The term "width" refers to the longest straight line horizontal distance between the pouch front and rear faces.

As set forth above, device 5 includes pin 25 that releasably attaches the pouch to first end 31 of support 30. The term "pin" refers to a piece of hardware that cooperates with the support to sustain the weight of the pouch during use. The pin is attached to the pouch via linker 26, which can include any element that permanently or releasably attaches the pin to the pouch. Suitable linkers can include (but are not limited to) a metal clip, string, elastic cord, clip, snap, loop, button, magnet, VELCRO®, and the like. For example, the linker can be configured as a loop that extends through pouch aperture 45, as shown in FIGS. 2*a* and 2*b*.

Figure 3A:
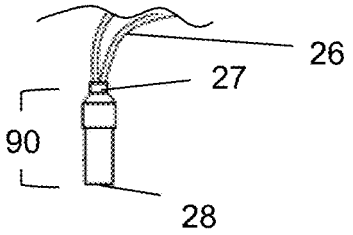
FIG. 3*a* is a front plan view of a device pin and linker in accordance with some embodiments of the presently disclosed subject matter.

FIG. 3*a* illustrates one embodiment of pin 25 defined by first end 27 that is connected to linker 26 and opposed second end 28 that cooperates with support 30. The pin can have any desired shape so long as it cooperates with the support to maintain the weight of the pouch. The pin can be attached to the linker using any mechanism, such as (but not limited to) the use of adhesives, welding, mechanical elements (e.g., clips, fasteners), and the like.

Figure 3B:
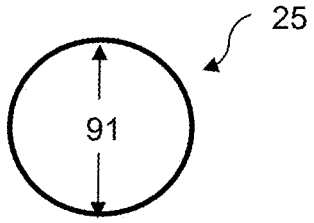
FIG. 3*b* is a cross sectional view of a device pin showing the pin diameter in accordance with some embodiments of the presently disclosed subject matter.

In some embodiments, the pin can include length 90 of at least about (or no more than about) 0.5, 1, 1.5, 2, 2.5, or 3 inches. The pin can also include diameter 91 of about 0.25 inches (e.g., at least/no more than about 0.2, 0.25, 0.3, 0.35, 0.4, 0.45, 0.5 inches) as shown in FIG. 3*b*. The term "diameter" refers to the longest straight-line distance that passes through a midpoint of the cross-sectional shape of item. In some embodiments, the pin second end can have the same cross-sectional shape as the cavity positioned within the first end of the support member, allowing for attachment.

Figure 3C:
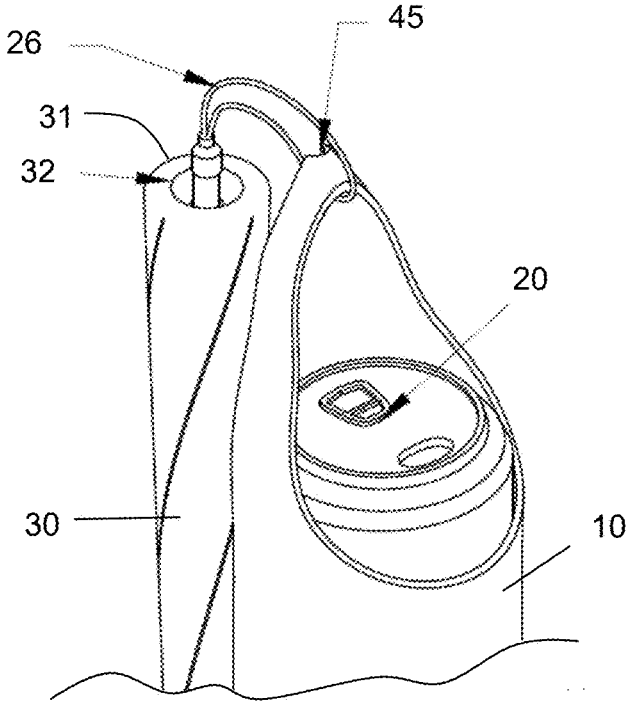
FIG. 3*c* is a perspective view of a device pin positioned within a cavity of a support member in accordance with some embodiments of the presently disclosed subject matter.
Figure 3D:
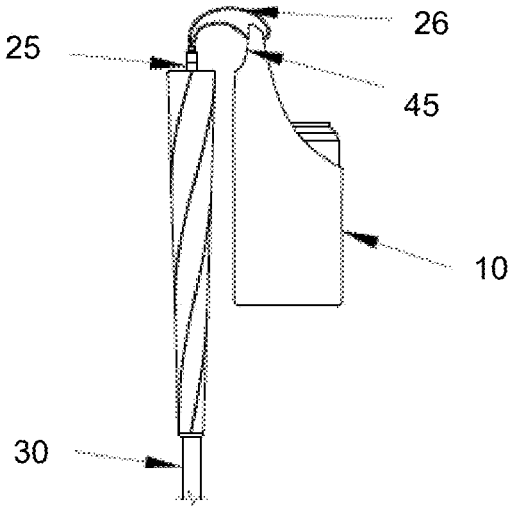
FIG. 3*d* is a fragmentary side plan view of a device pin positioned within a cavity of a support member in accordance with some embodiments of the presently disclosed subject matter.

As shown in FIGS. 3*c* and 3*d*, pin 25 is inserted into the top of support member 30 during use to secure the pouch in place. Specifically, first end 31 of the support includes cavity 32 that is sized and shaped to accommodate the second end of the pin. The term "cavity" includes any type of opening. The diameter of cavity 32 is greater than the diameter of corresponding pin 25 (e.g., at least 1, 5, 10, 20, 30, 40, 50, 60, 70, or 80 percent larger). The pin is designed to provide a stable connection between the pouch and support member while allowing for easy removal and reattachment, making the device adaptable to different outdoor scenarios.

Figure 3E:
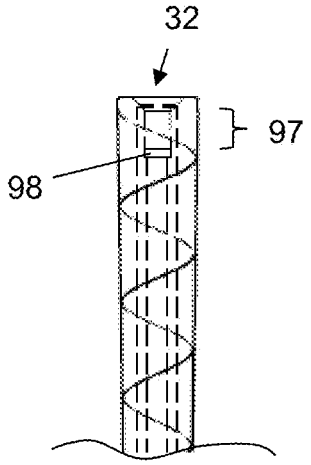
FIG. 3*e* is a cross-sectional view of a device support comprising a cavity in accordance with some embodiments of the presently disclosed subject matter.
Figure 3F:
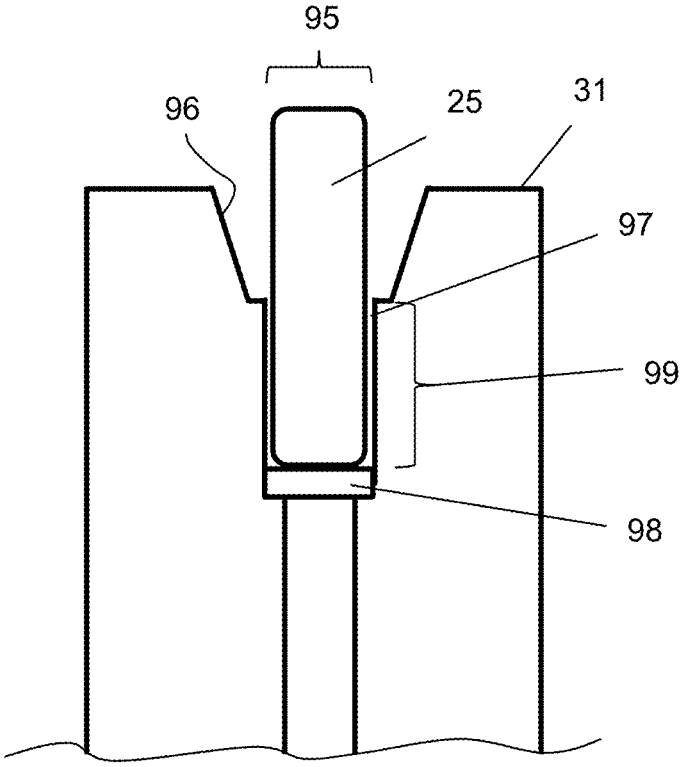
FIG. 3*f* is a cross-sectional view of a device cavity and seated pin in accordance with some embodiments of the presently disclosed subject matter.

FIGS. 3*e* and 3*f* illustrate one embodiment of cavity 32 positioned at the first end of the support. As illustrated, the cavity includes beveled region 96 positioned adjacent to the top edge of the support. The term "beveled" refers to any angled or tapered region. The tapered region funnels into housing 97 that cooperates with the pin during use. In some embodiments, the diameter 95 of the housing is about 0.3 inches (e.g., at least/no more than about 0.2, 0.25, 0.3, 0.35, 0.4, 0.45, 0.5, 0.55 inches). The cavity housing can have depth 99 of about 0.5 inches (e.g., at least/no more than about 0.25, 0.5, 0.75, 1, 1.25, 1.5, 1.75, 2, 2.25, 2.5, 2.75, or 3 inches).

In some embodiments, the lowest point of the cavity housing includes retention element 98 that assists in releasably maintaining the pin in the cavity housing. In some embodiments, the retention element is a magnet that attracts the first end of the pin to keep the pin within the cavity housing. However, the presently disclosed subject matter is not limited and the retention element can include any element, such as a snap fit closure, press fit closure, and the like.

As shown in FIG. 3*f*, the pin seats into the cavity to securely hold the associated pouch and beverage (or other item 20). The retention element (e.g., magnet) helps to guide the pin into position within the cavity housing. In some embodiments, once the pin second end 28 is seated against the retention element, a noise (e.g., click) can be observed. The noise can serve as verification to the user that the pin is properly seated within the cavity.

As shown in FIG. 3*f*, when the pin is inserted into the support cavity, a portion of the pin first end extends above the support. For example, about 10-50 percent (e.g., at least/no more than about 10, 15, 20, 25, 30, 35, 40, 45, or 50 percent) of the length of the pin can extend above the support. The extending region of the pin can be used to grasp the pin during insertion or removal from the cavity. In this way, the pouch is easily removed from the support member when desired.

Figure 4:
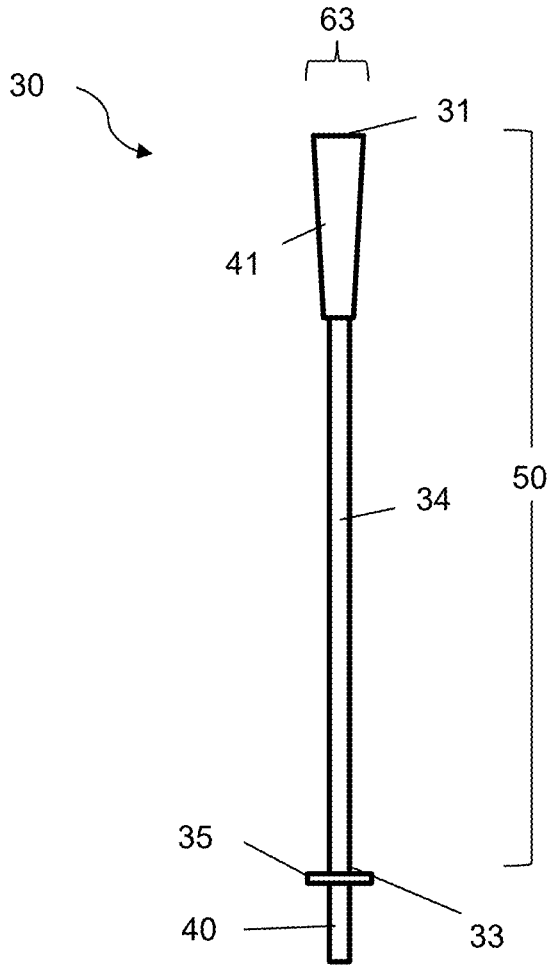
FIG. 4 is a side plan view of a support member and attached flange and anchor in accordance with some embodiments of the presently disclosed subject matter.

One embodiment of support member 30 is illustrated in FIG. 4. As shown, the support includes first end 31 and opposed second end 33 with length 34 therebetween. In some embodiments, the length of the support member can be adjusted as desired by the user. For example, the support member can include telescoping inner and outer tubes. The term "telescoping" refers to a mechanical action of at least two longitudinal bodies of congruent cross-sections sliding relative to each other along a common longitudinal axis. It should further be appreciated that the length of support member 30 can be adjusted using any known mechanism and is not limited to a telescoping arrangement. For example, the support member can include a plurality of segments that can be added or removed as desired to achieve a suitable height. In other embodiments, the length of support member 30 is not adjustable.

Support member 30 can have any desired cross-sectional shape. For example, the support member can be configured with a circular, oval, square, rectangular, triangular, pentagonal, hexagonal, octagonal, heart, diamond, or abstract cross-sectional shape.

Optionally, first end 31 of the support can include grip 41 that provides comfort during use, allowing a user to easily grasp and retain the support. The grip can be constructed from any material, such as (but not limited to) rubber, padded fabric, thermoplastic material, leather, and the like.

The support member can be constructed from any material, such as metal (e.g., aluminum, steel), plastic, wood, or combinations thereof. Thus, the support member can be manufactured using lightweight yet durable materials to ensure ease of transport while maintaining structural integrity. In some embodiments, support 30 can be configured as a hollow or solid tubing.

The support member can include any desired dimensions, such as length 50 of about 20-60 inches (e.g., at least/no more than about 20, 30, 40, 50, or 60 inches). The term "length" refers to the distance between first and second ends 31, 33 of the support. However, the presently disclosed subject matter is not limited and the length of support 30 can be outside of the noted range. The support member can have width 63 of about 0.5-3 inches in some embodiments (e.g., 0.5, 1, 1.5, 2, 2.5, or 3 inches).

Figure 5A:
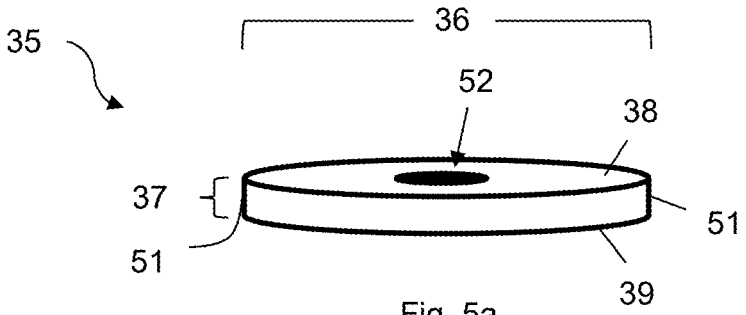
FIG. 5*a* is a perspective view of a device flange in accordance with some embodiments of the presently disclosed subject matter.
Figure 5B:
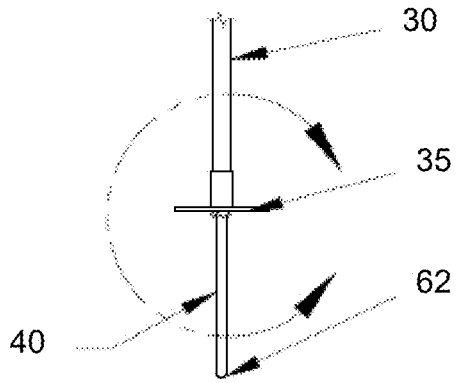
FIG. 5*b* is a fragmentary side plan view of a support member, flange, and anchor in accordance with some embodiments of the presently disclosed subject matter.

Second end 33 of the support is positioned adjacent to flange 35 and anchor 40. Flange 35 can be used as a stopping point for the insertion of the anchor into a support surface, such as the ground. Stated another way, the support cannot be inserted into the ground past the flange. As shown in FIGS. 5*a* and 5*b*, the flange can have a round or circular cross sectional shape in some embodiments, although any shape can be used. The flange is configured around support 30 and thus can include central hole 52 to accommodate the support second end. Thus, the flange can be attached to the second end of the support using any mechanism, such as the use of screw threads, adhesive, welding, clips, snap-fit closure, and the like.

Flange 35 can include width 36 of about 3-12 inches in some embodiments (e.g., at least/no more than about 3, 4, 5, 6, 7, 8, 9, 10, 11, 12 inches). The flange can also include thickness 37 of about 0.1-2 inches (e.g., at least/no more than about 0.1, 0.5, 1, 1.5, or 2 inches). The "width" of the flange is the longest horizontal distance between side edges 51. The "thickness" refers to the longest vertical distance (e.g., between top and bottom faces 38, 39).

Flange 35 can be constructed from any material, such as metal (e.g., steel, stainless steel), wood, hard plastic, and the like.

The flange is connected to the anchor and support member, as noted above. In use, the flange aids in inserting anchor 40 into the ground and enhances stability. The flange can be stepped on by a user to assist in driving the anchor deeper into the ground, ensuring a firm and secure hold. The design of the flange minimizes lateral movement, making the holder more reliable in windy conditions and less prone to movement.

Thus, in use, the flange extends radially outward from the support member second end to enable a user's foot to engage and apply axial pressure to the device to push the anchor into the ground. Further, it also may be beneficial when removing the support member from the ground to position a tool or the user's foot against the underside of the flange. To provide sufficient support for the anchor when inserted into the ground, the flange can be positioned about 5 inches from the bottom tip 62 of the anchor (e.g., at least 2, 3, 4, 5, 6, 7, 8, 9, or 10 inches).

Anchor 40 is positioned at the second end of the holder device, adjacent to flange 35. The term "anchor" broadly refers to any element that provides weight and/or a mechanism by which to secure the holder device into a support surface (e.g., sand, dirt, grass, rocks). The anchor can be permanently attached to the flange using adhesives, welding, screw threads, and the like. The anchor is designed to penetrate a variety of terrain types, including grass, rocks, pebbles, sand, and compacted soil, providing versatility for different outdoor environments.

Lower end 62 of the anchor can be configured as a spike or pointed end to initiate insertion of the anchor into the support surface. Because the anchor is inserted into a support surface, it does not rotate and remains in the inserted position until the user desires to remove it. Likewise, the support member does not rotate or move due to its attachment to anchor 40.

The anchor can be constructed from any material, such as metal (e.g., steel, stainless steel), wood, hard plastic, and the like.

Figure 6A:
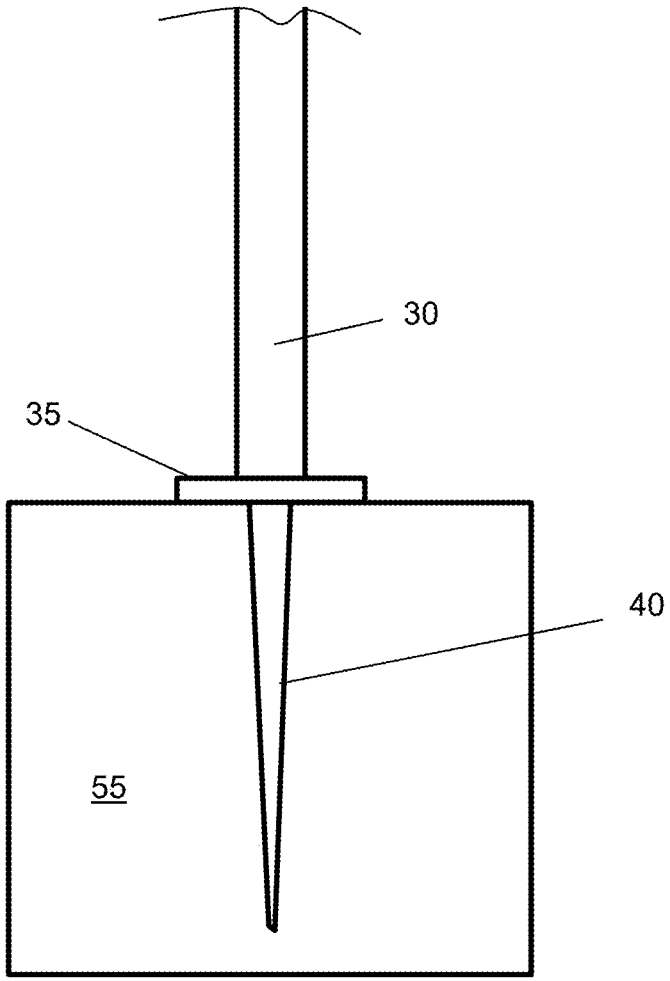
FIG. 6*a* is a cross-sectional view of an anchor and flange in use in accordance with some embodiments of the presently disclosed subject matter.
Figure 6B:
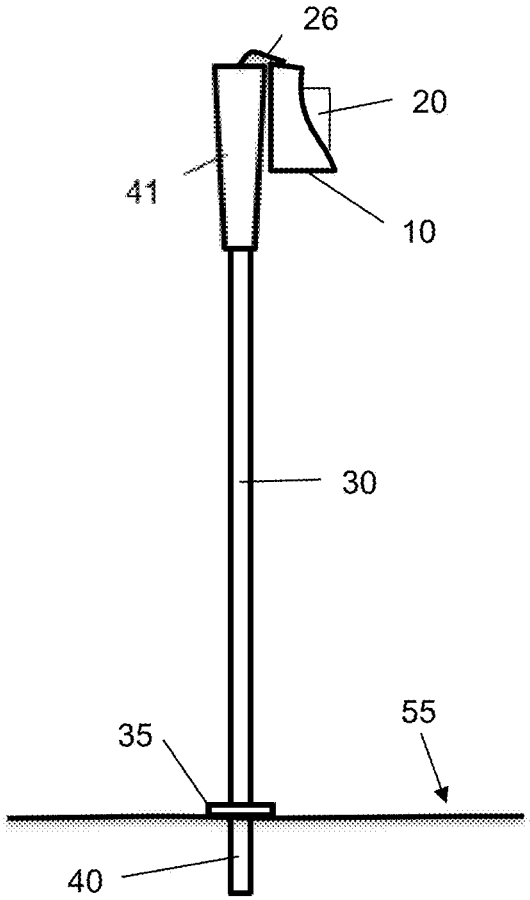
FIG. 6*b* is a front plan view of a holding device in use with a horizontal support surface in accordance with some embodiments of the presently disclosed subject matter.

In use, device 5 can be easily used to hold one or more items 20 within the interior of pouch 10. Once a user arrives at a desired location (e.g., the beach, campsite), the user can exert light to medium pressure by gripping the support member and positioning anchor 40 into the ground. In some embodiments, a user can exert pressure to allow the anchor to traverse the ground by stepping on flange 35. The flange acts as a stop, such that the device cannot be positioned any further into ground 55, as shown in FIGS. 6*a* and 6*b*.

Before or after insertion of the anchor into the ground, the user can add a desired item 20 to the interior of the pouch for storage or use (e.g., drinking). Pin 25 can then be attached to the cavity in the first end of the support to releasably connect the pouch to the support.

Figure 6C:
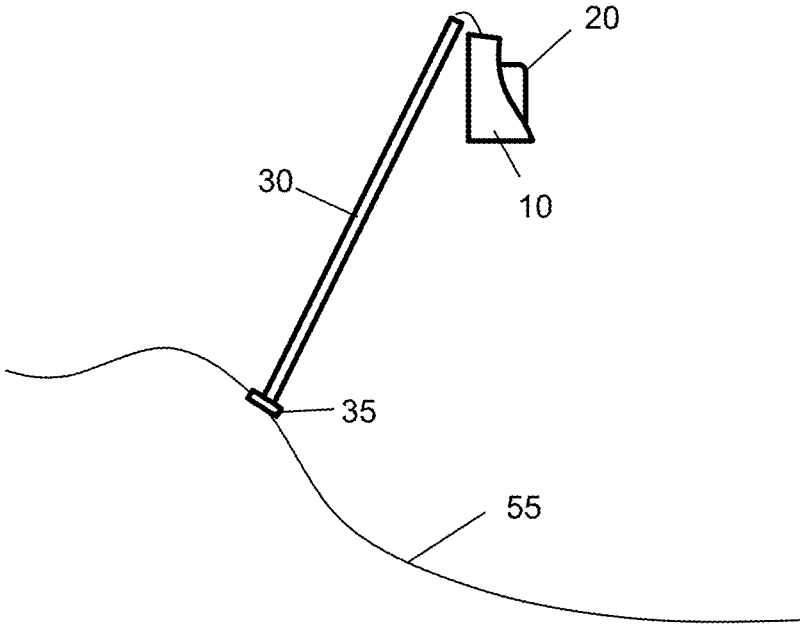
FIG. 6*c* is a front plan view of a holding device in use with an uneven support surface in accordance with some embodiments of the presently disclosed subject matter.
Figure 6D:
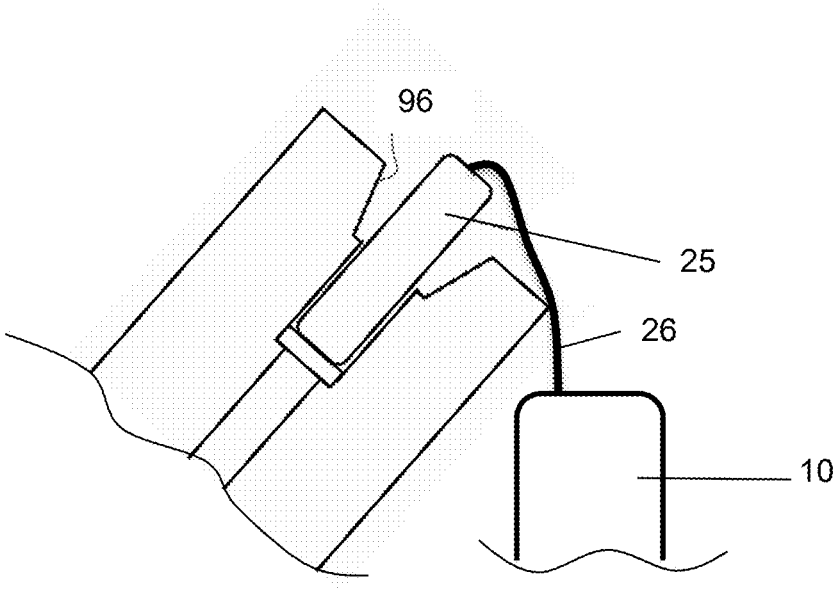
FIG. 6*d* is a fragmentary view of a pin positioned in a support member first end on angled terrain in accordance with some embodiments of the presently disclosed subject matter.

The articulating joint connecting the pouch to the support member at the interaction between the pin second end and the cavity allows the pouch to remain upright even when the support member is inserted at an angle. As a result, device 5 is particularly useful in uneven terrain conditions. The term "articulating joint" refers to the class of joints that allow at least one rotational degree of freedom but no translational degree of freedom. Examples of articulating joints include spherical bearings (e.g., rod-end bearings (e.g., Heim joints) and ball joints) and hinge joints. Thus, even when support 30 is positioned on uneven terrain, as shown in FIG. 6*c*, the contents of the pouch remain upright (e.g., the pouch contents and pouch are horizontal or level). In this way, an open beverage bottle housed within the pouch interior will not spill and small items (e.g., keys) will not be released from pouch interior 13.

The articulating joint ensures adequate mechanical stabilization between the pin and the support member cavity to support the weight of the pouch and any contents. In some embodiments, the pin can pivot with respect to the cavity (e.g., around the axis of the cavity interior) in response to the outside terrain unevenness, for example.

Furthermore, the overall design of device 5 allows for quick setup and removal, making it ideal for outdoor enthusiasts who require convenience and portability. The modular construction enables users to disassemble and transport the device efficiently, ensuring that it can be packed and stored with minimal space requirements.

When a user desires to access item 20, they can simply remove the item from the pouch interior, while the remainder of the device remains in position in the ground. Alternatively, the pin can be removed from the support cavity, allowing the pouch to be quickly and easily separated from support member 30. Thus, the user can remove a beverage bottle from the pouch interior, have a sip, and then conveniently return it to the pouch interior until another drink is desired. Similarly, when the beverage container is empty, it can be removed and replaced with a new one (e.g., a fresh drink).

When the device is no longer needed, a user can simply detach the pouch from the support by applying light upward pressure to the pin, dislodging it from the support first end. The pouch and contents can then be stowed as desired. A user then can apply an upward force to the support and/or flange to remove it from the ground. The device can then be stored for later use.

The presently disclosed subject matter offers many advantages over prior art drink holders. For example, the disclosed device provides a simple and effective solution that allows the user to place a beverage or small personal items in a secure pouch attached to a ground-inserted support.

The holding device can be easily used in a variety of environments, including uneven ground.

Device 5 can be easily repositioned as needed.

The disclosed holder is hands-free and frees a wearer from the task of continuously holding a beverage container.

The device is easy to use, such that even children or the elderly can use it.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A device, comprising:

a pouch with a top end and an opposed bottom end, an opening in fluid communication with a front side of the pouch, and an aperture positioned at a first end of the pouch on a rear side of the pouch;

a pin comprising a first end and an opposed second end, wherein the first end of the pin is attached to the first end of the pouch via a linker;

an elongated support member comprising a first end and an opposed second end with a length therebetween, wherein the support member first end includes a cavity, and wherein the cavity includes a beveled region positioned adjacent to the first end of the support member and a housing that is sized and shaped to accommodate the second end of the pin;

a flange positioned at the second end of the support member, the flange having a diameter that is greater than a diameter of the support member, wherein the flange includes a first side positioned adjacent to the second end of the support and an opposed second side;

an anchor positioned adjacent to the second end of the support;

wherein the device includes a first orientation wherein the pin second end is removably housed within the cavity housing at the first end of the support via an articulating joint and a second orientation wherein the pin second end is withdrawn from the cavity;

wherein in the first configuration, the pouch remains horizontal regardless of an angle of the support.

2. The device of claim 1, wherein the pouch is constructed from one or more insulated materials.

3. The device of claim 1, wherein the pouch is constructed from one or more waterproof or water-resistant materials.

4. The device of claim 1, wherein the cavity housing includes a retention element at a bottom end of the cavity housing that cooperates with the second end of the pin.

5. The device of claim 1, wherein the linker is selected from one or more of a metal clip, string, elastic cord, clip, snap, loop, button, magnet, or hook and loop closure.

6. The device of claim 1, wherein the support member is constructed from lightweight, corrosion-resistant materials.

7. The device of claim 1, wherein the anchor includes a first end positioned adjacent to the second side of the flange and an opposed second end configured as a chamfered tip.

8. The device of claim 1, wherein the pin first end extends above the first end of the support member in the first configuration.

9. The device of claim 1, wherein the length of the support member is adjustable in size, length, or both.

10. A method of storing an item in the pouch of the device of claim 1, the method comprising:

positioning the item within the pouch interior;

positioning the second end of the pin within the support member cavity to releasably attach the pouch to the support member first end;

positioning the anchor into a support surface such that the support member and pouch are stabilized into position and the item is stored within the pouch.

11. The method of claim 10, wherein the item is a beverage.

12. The method of claim 11, wherein the beverage is a bottle, can, or other container.

13. The method of claim 10, wherein the item is selected from one or more keys, phones, wallets, purses, coins, money, credit cards, or jewelry.

14. The method of claim 10, further comprising folding the pouch rear side onto itself.

15. The method of claim 14, wherein the pouch is constructed from one or more flexible materials.

16. The method of claim 14, wherein the item can be removed from the pouch interior at any desired time.

17. The method of claim 10, wherein the pouch is constructed from one or more insulated materials, waterproof materials, water-resistant materials, or combinations thereof.

18. The method of claim 10, wherein the linker is selected from one or more of a metal clip, string, elastic cord, clip, snap, loop, button, magnet, or hook and loop closure.

19. The method of claim 10, wherein the support member is constructed from lightweight, corrosion-resistant materials.

20. The method of claim 10, wherein the anchor includes a first end positioned adjacent to the second side of the flange and an opposed second end configured as a chamfered tip.

* * * * *